US007347587B2

(12) United States Patent
Pfund et al.

(10) Patent No.: US 7,347,587 B2
(45) Date of Patent: Mar. 25, 2008

(54) APPARATUS FOR REDUCING SOCKET SHADOW

(75) Inventors: David Pfund, Woodbridge, CT (US); James A. Melling, New Haven, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 0 days.

(21) Appl. No.: 11/593,660

(22) Filed: Nov. 6, 2006

(65) Prior Publication Data

US 2007/0109789 A1 May 17, 2007

Related U.S. Application Data

(60) Provisional application No. 60/733,628, filed on Nov. 4, 2005.

(51) Int. Cl.
*F21Y 103/00* (2006.01)

(52) U.S. Cl. ..... 362/260; 362/219; 362/225; 362/297; 362/346

(58) Field of Classification Search ..... 362/346, 362/297, 298, 301, 260, 217, 219, 224, 225
See application file for complete search history.

(56) References Cited

U.S. PATENT DOCUMENTS

2002/0085365 A1* 7/2002 Lu et al. ..... 362/3
2003/0137843 A1* 7/2003 Mier-Langner et al. ..... 362/285
2003/0227767 A1* 12/2003 Lee et al. ..... 362/23

* cited by examiner

*Primary Examiner*—Laura Tso
(74) *Attorney, Agent, or Firm*—Cantor Colburn LLP

(57) ABSTRACT

Disclosed is an apparatus for reducing socket shadow in an area of low luminance, the apparatus comprising a luminaire casing, at least two linearly adjacent tandem lamps disposed in the luminaire casing, the at least two lamps each capable of emitting a light output, a region of diminished radiant exitance disposed between adjacent ends of the at least two linearly adjacent lamps, the region of diminished radiant exitance emitting a lower light output than the light output emitted from the at least two lamps and creating the area of low luminance, and a reflector disposed with the luminaire casing, the reflector being disposed proximate the at least two lamps and positioned with respect to the at least two lamps to redirect the light output emitted from the at least two lamps to the area of low luminance.

24 Claims, 5 Drawing Sheets

APPARATUS FOR REDUCING SOCKET SHADOW

CROSS-REFERENCE TO RELATED APPLICATIONS

This application claims the benefit of U.S. Provisional Application 60/733,628 filed on 4 Nov. 2005, the contents of which are incorporated by reference herein in their entirety

FIELD OF THE INVENTION

The disclosure relates generally to an apparatus for reducing socket shadow in an area of low luminance, and more particularly to a reflector disposed within a luminaire for reducing socket shadow in an area of low luminance.

BACKGROUND OF THE INVENTION

Luminaires employing elongated fluorescent lamps designed to direct lamp rays broadly and upwardly toward a target surface (e.g. ceiling), thereby achieving general illumination by reflection of said light rays from said target surface (ceiling), are well known in the industry. Similarly known are luminaires that are positioned adjacent to vertical surfaces in a manner that directs light output upwardly toward, e.g., a ceiling, and broadly away from the vertical surface/wall. Such luminaires may contain multiple elongated lamps aligned in tandem within a single elongated housing.

It is equally well known that elongated fluorescent lamps produce less light output (radiant exitance) in cathode regions located at the ends of the lamp as compared to light output at a central region of the lamp, i.e. the area between the cathode regions. Each cathode region is generally defined as an area around the lamp's internal electrodes. In some cases, the region of diminished output at the cathode region may be approximately 1½" to 2" in length. In addition, these elongated fluorescent lamps have an opaque closure cap on each end that is generally ½" in length from which no light is emitted. In elongated luminaires where tandem lamping is used, the occurrence of back-to-back lampholder brackets and lampholders, combined with the adjacent lamp caps and low-output cathode regions of the lamps, results in an extended region of diminished radiant exitance at a central point along the length of the luminaire (in the case where two similar sized lamps are used). This area of diminished output has little or no effect upon the distribution of luminance on a surface or area distant from the luminaire. However, this condition invariably results in a noticeable reduction in surface luminance (hereinafter sometimes referred to as, "socket shadow") on any surface proximate to the lamps. It is generally desirable and advantageous to eliminate occurrences of socket shadow.

Since luminaires such as those discussed above generally employ an opaque or perforated backlight shield to manage/modify the direct illumination of a vertical surface occurring adjacent to the luminaire along the major portion of the lamp(s), it is common to reduce the width of the back light shield or eliminate the shield near the ends of each lamp in an effort to reduce occurrences of socket shadow between adjacent tandem mounted luminaires. However, this practice does not fully eliminate socket shadow and additional reduction is desirable. Accordingly, it is desirable and advantageous to provide a device for achieving greater reduction of socket shadow on the vertical surface proximate to a tandem lamp luminaire which does not substantially degrade a desired light output of the luminaire.

SUMMARY OF THE INVENTION

Disclosed is an apparatus for reducing socket shadow in an area of low luminance, the apparatus comprising a luminaire casing, at least two linearly adjacent tandem lamps disposed in the luminaire casing, the at least two lamps each capable of emitting a light output, a region of diminished radiant exitance disposed between adjacent ends of the at least two linearly adjacent lamps, the region of diminished radiant exitance emitting a lower light output than the light output emitted from the at least two lamps and forming the area of low luminance, and a reflector disposed with the luminaire casing, the reflector being disposed proximate the at least two lamps and positioned with respect to the at least two lamps to redirect the light output emitted from the at least two lamps to the area of low luminance.

Also disclosed is an apparatus for reducing socket shadow in an area of low luminance, the apparatus comprising a luminaire casing including at least one contact side, at least one lamp disposed in the luminaire casing, the at least one lamp including two ends, at least one of the two ends contacting the at least one contact side, the lamp capable of emitting a light output, a region of diminished radiant exitance disposed between at least one of the two ends of the at least one lamp and the at least one contact side, the region of diminished radiant exitance emitting a lower light output than the light output emitted from the at least two lamps, and a reflector disposed with the luminaire casing, the reflector being disposed proximate the at least one lamp and positioned with respect to the at least one lamp to redirect the light output emitted from the at least one lamp to the area of low luminance.

Further disclosed is an apparatus for reducing socket shadow in an area of low luminance, the apparatus comprising at least two linearly adjacent tandem luminaire casings each including at least one lamp capable of emitting a light output, a region of diminished radiant exitance disposed substantially between adjacent ends of the at least two linearly adjacent luminaire casings, the region of diminished radiant exitance emitting a lower light output than the light output emitted from said at least one lamp, and a reflector separately disposed with each of the at least two luminaire casings, the reflector being disposed proximate the at least one lamp and positioned with respect to the at least one lamp in each of the at least two casings to redirect the light output emitted from the at least one lamp to the area of low luminance.

Also disclosed is a reflector for reducing socket shadow in an area of low luminance created by linearly tandem lamps of a luminaire. The reflector includes a first reflective generally planar surface, a second reflective generally planar surface, and fixation means for securing the reflector within the luminaire, where the first and second reflective surfaces are connected at first ends thereof, and where the first and second reflective surfaces are disposed within the luminaire at an angle of about 10 to 30 degrees with respect to a longitudinal axis of the tandem lamps and at an angle of about 2 to 10 degrees with respect to a vertical.

BRIEF DESCRIPTION OF THE FIGURES

The following descriptions should not be considered limiting in any way. With reference to the accompanying drawings, like elements are numbered alike.

DETAILED DESCRIPTION

Figure 1:
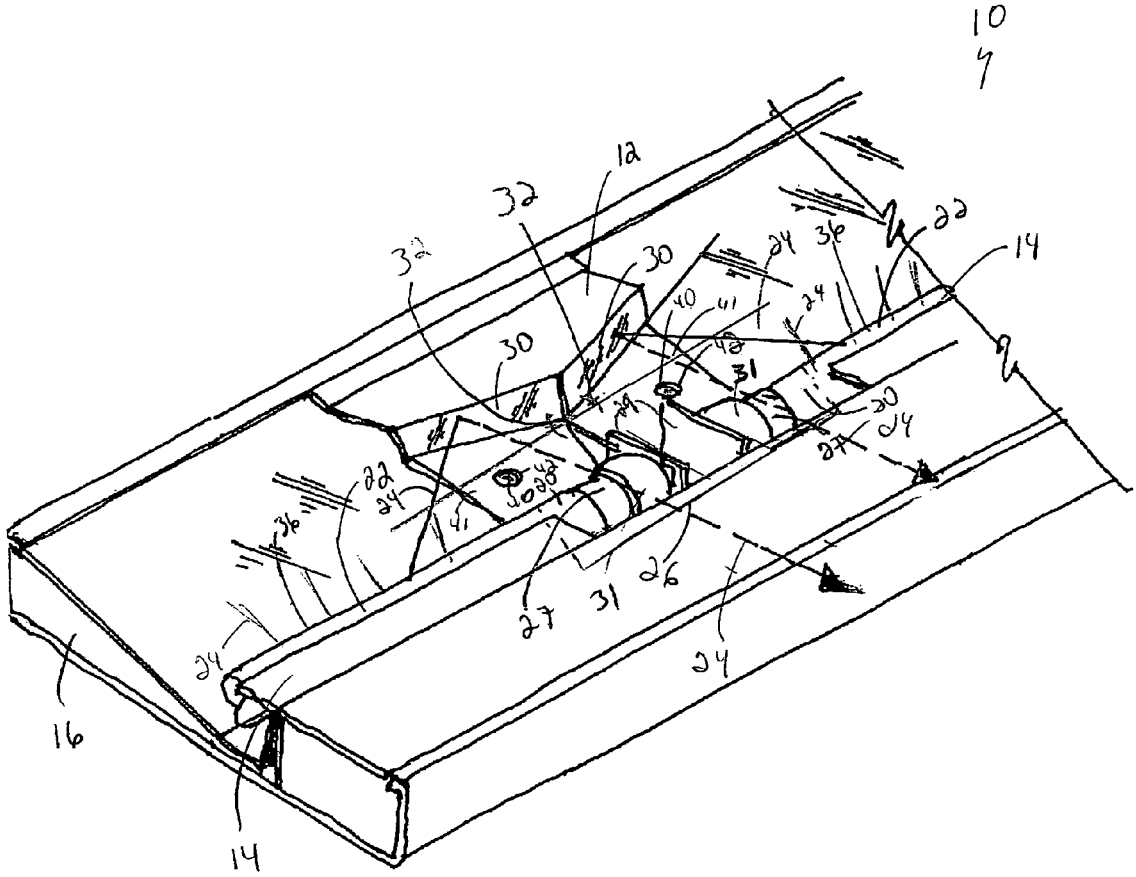
FIG. 1 is a partial side perspective view of a luminaire including one embodiment of an apparatus for reducing socket shadow.
Figure 2:
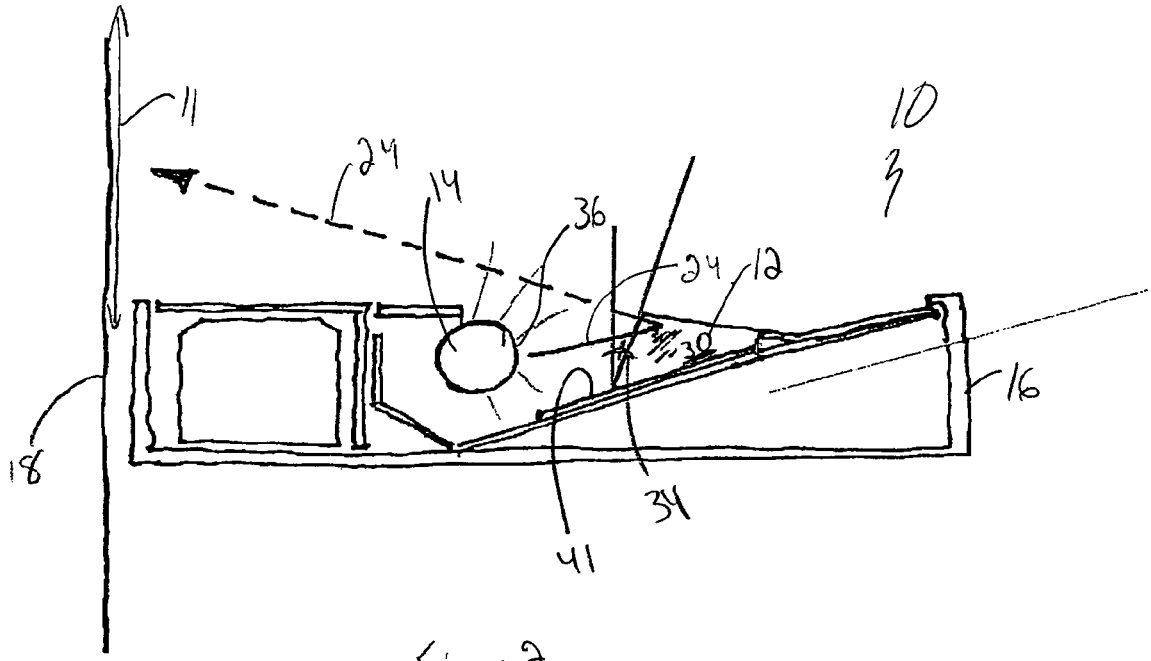
FIG. 2 is a cross-section of the luminaire of FIG. 1.

Referring to FIGS. 1 and 2, an exemplary embodiment of a luminaire 10 illustrated. The luminaire 10 includes a reflector 12 for reducing socket shadow and at least two linearly adjacent tandem lamps 14 disposed within a luminaire casing 16. In the exemplary embodiment of FIGS. 1 and 2, the luminaire 10 is disposed adjacent to a vertical surface 18 (such as a wall) in a manner that directs light output from the lamps 14 upwardly and broadly away from the vertical surface 18. The reflector 12 and its components are configured and positioned to direct light onto an area 11 of low luminance (i.e. socket shadow area) located at this surface 18. The manner by which the reflector 12 directs light to this area 11 will be described hereinbelow.

As mentioned above the luminaire 10 includes at least two linearly adjacent tandem lamps 14 disposed within the luminaire casing 16. As many lamps 14 as is desirable may be disposed end to end (i.e. linearly or substantially linearly) within the casing 16, with FIGS. 1 and 2 illustrating the exemplary two adjacent lamps 14. The lamps 14 each include two cathode regions 20 generally defined areas around internal electrodes of each lamp 14 (only one region 20 is illustrated for each), with a central region 22 of each lamp 14 is defined between these regions 20. When the lamps 14 are in use, these central regions 22 emit a light output 24 that ultimately illuminates a target surface, for example, a ceiling (not illustrated) disposed above the luminaire 10 and generally perpendicular to the vertical surface 18.

Located between the cathode regions 20 of the two separate tandem lamps 14 shown in the exemplary embodiment of FIGS. 1 and 2 is a region of diminished radiant exitance 26. The region of diminished radiant exitance 26 9 as shown in the embodiment of FIGS. 1 and 2) at least comprises the cathode regions 20 of the lamps 14, opaque closure caps 27 of each lamp 14, lampholder brackets 29 for each lamp 14, and lampholders 31 for each lamp 14. Being that there is little or no light emitted from this area of the luminaire 10, the region of diminished radiant exitance 26 emits a "diminished" light output as compared with the light output 24 of the central regions 22 of the lamps 14. As such, the area 11 on any surface proximate to the luminaire 10, such as the vertical surface 18, receives a noticeably reduced surface luminance (i.e. socket shadow) from the region of diminished radiant exitance 26.

To remedy this area 11 of low luminance, the reflector 12 is disposed with the luminaire casing 16. In an exemplary embodiment, the reflector 12 comprises two flat erect and angled surfaces 30 having a specular finish (though any semi-specular or otherwise reflective flat or textured finish may be used in alternate embodiments of the reflector 12). The surfaces 30 are positioned at opposed horizontal angles 32 to the two lamps 14 respectively, and reclined from the two lamps 14 at a vertical angle 34. In this exemplary embodiment, the horizontal angles 32 are approximately 10 to 30 degrees relative to the longitudinal axis of the lamps 14. In another embodiment, the horizontal angles are approximately eighteen degrees. The vertical angle 34 is approximately 2 to 10 degrees relative to the vertical surface 18. In another embodiment, the vertical angle 34 is approximately 6 degrees. This positioning allows the surfaces 30 of the reflector 12, when disposed within the luminaire casing 16 proximate to lamps 14 (as is shown in FIGS. 1 and 2), to receive light output 24 directly from a forward facing side 36 of the central region 22 of the lamps 14, and redirect the output light 24 to the area 11 of low illuminance, thus reducing socket shadow on the surface 18.

It should be appreciated that, in one exemplary embodiment, the reflector 12 may be disposed with the luminaire casing 16 via a threaded mounting. As shown in FIGS. 1 and 2, the reflector 12 is threadingly mounted to the luminaire casing 16 via threaded instruments 40 disposed through mounting openings 42 delimited by a generally horizontal edge 41 extending from the reflector 12. This threaded association fixedly mounts the reflector 12 with the casing 16, allowing the angles and positioning discussed above to remain constant.

As shown in FIGS. 1 and 2, the reflector 12 for reducing socket shadow is disposed at a forward front portion of the luminaire casing 16. Here, front and forward are intended to generally mean a position or direction away from the vertical surface 18. The reflector 12 is disposed generally in front of the region of diminished radiant exitance 26 of the lamps 14. In this embodiment of the luminaire 10, specular surfaces are disposed adjacent to the reflector 12 on opposite sides thereof at the front area of the luminaire casing 16. Particularly, the specular surfaces are arranged in front of the central, high luminance regions 22 of the lamps 14. These specular surfaces are designed and oriented to reflect the light 24 output from the lamps 14 toward a target surface, for example, a ceiling. The reflector 12 is disposed in the low luminance area in front of the region of diminished radiant exitance 26 of the lamps 14. Thus, the reflector 12 advantageously does not interfere with the light 24 emitted from the central region 22 of the lamps 14 incident upon the specular surfaces adjacent to the reflector 12. Accordingly, the output light 24 reflected by the specular surfaces toward the target area is not significantly diminished nor obstructed by the presence of the reflector 12.

Figure 3:
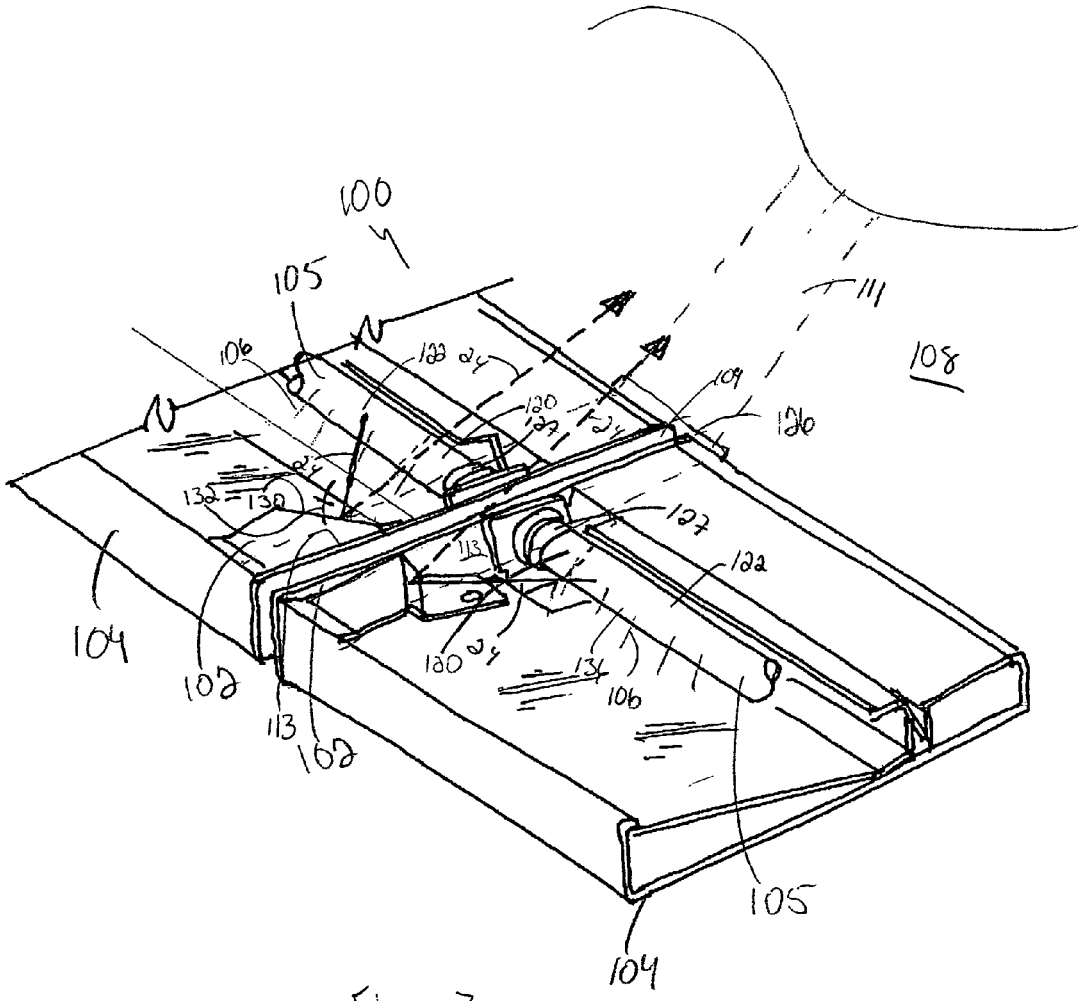
FIG. 3 is a partial side perspective view of a luminaire including another embodiment of the apparatus for reducing socket shadow.
Figure 4:
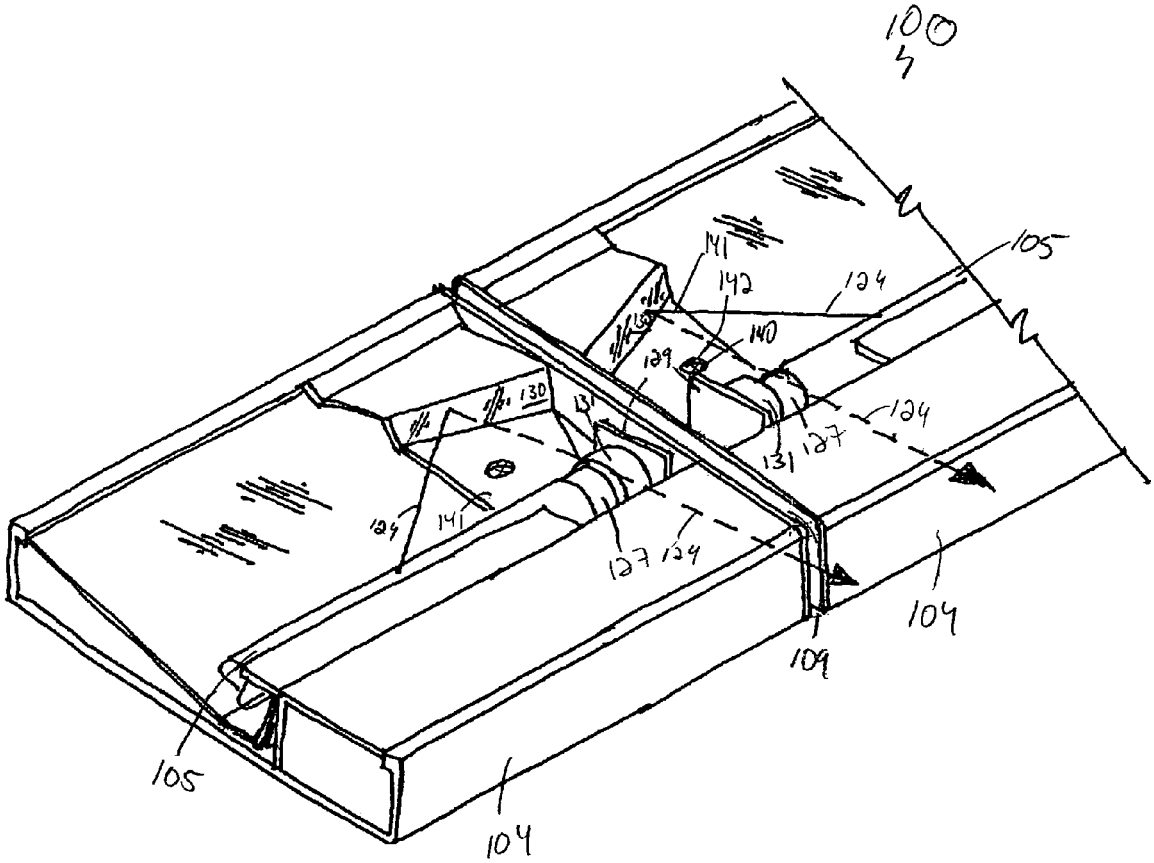
FIG. 4 is a partial side perspective view of the luminaire of FIG. 3 from a different angle.
Figure 5:
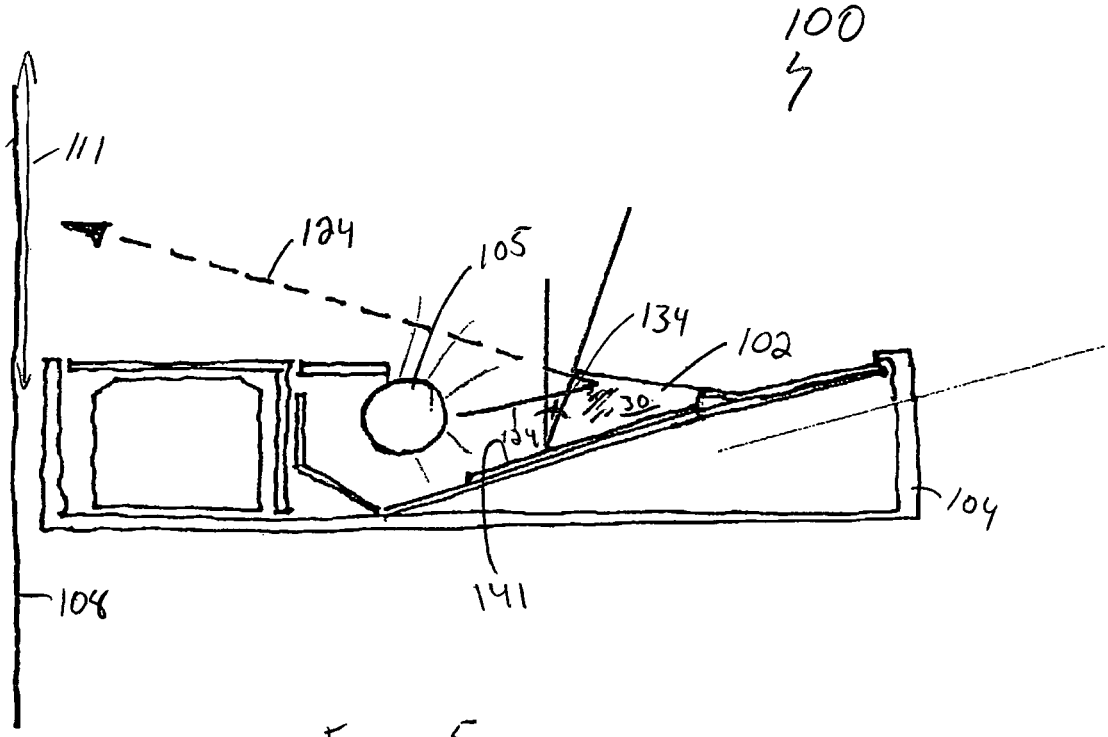
FIG. 5 is a cross-section of the luminaire of FIG. 3.

Referring to FIGS. 3-5, another exemplary embodiment of an luminaire 100 is illustrated. The luminaire 100 includes a reflector 102 for reducing socket shadow disposed within each of at least two linearly adjacent luminaire casings 104, wherein each casing 104 includes at least one lamp 105 capable of emitting a light output 106 when in use. In the exemplary embodiment of FIGS. 3-5, the luminaire 100 is disposed adjacent to a vertical surface 108 (such as a wall) in a manner that directs light output from the lamps 105 upwardly and broadly away from the vertical surface 108. The reflectors 102 are configured and positioned to direct light onto an area 111 of low luminance (i.e. socket shadow area) located at this surface 108. The manner by which the reflectors 102 direct light to this area 111 will be described hereinbelow.

As mentioned above the apparatus includes at least two linearly adjacent tandem luminaire casings 104. As shown in FIGS. 3-5, there exists a space 109 between adjacent contact sides 113 of these casings 104. This space 109 comprises a portion of a region of diminished radiant exitance 126, which will be discussed in greater detail below.

As many lamps 105 as is desirable may be disposed end to end (i.e. linearly or substantially linearly) within each casing 104, with FIGS. 3-5 illustrating one adjacent lamp 105 in each. The luminaire 100 may include any number of linearly adjacent casings 104, FIGS. 3-5 illustrate two exemplary casings 104. Similar to the previously discussed lamps 14, the lamps 105 each include two cathode regions 120 (only one region 120 is illustrated for each), with a central region 122 defined between these regions 120. When the lamps 105 are in use, these central regions 122 emit a light output 124 that ultimately illuminates a target surface, for example a ceiling (not illustrated).

Located between the cathode regions 120 of the two separate tandem lamps 105 shown in the exemplary embodiment of FIGS. 3-5 is the region of diminished radiant exitance 126 introduced briefly above. The region of diminished radiant exitance 126 (as shown in the embodiment of FIGS. 3-5) at least comprises the cathode regions 120 of each lamp 105, an opaque cap 127 of each lamp 105, the contact sides 113 that each of the lamps 105 respectively contact, a lampholder bracket 129 of each lamp 105, a lampholder 131 of each lamp 105, and the space 109 between the sides 113. Being that there is effectively no lamp or light source disposed here, the region of diminished radiant exitance 126 coupled with the space 109 comprise the region 115 that includes diminished radiant exitance when compared with the light output 124 of the central regions 122 of the lamps 105. As such, the area 111 on any surface proximate to the luminaire 100, such as surface 108, receives a noticeably reduced surface luminance (i.e. socket shadow) from the region 115 of diminished radiant exitance.

To remedy this area 111 of low luminance, the reflector 102 is disposed within each luminaire casing 104. In an exemplary embodiment, the reflector comprises a flat erect and angled surface 130 having a specular finish (though any semi-specular or otherwise reflective flat or textured finish would be acceptable). The surface 130 is positioned at a horizontal angle 132 to each lamp 105 it shares a casing 104 with, and reclined from each lamp 105 at a vertical angle 134. In this exemplary embodiment, the horizontal angle 132 is approximately 10 to 30 degrees relative to the longitudinal axis of the lamps 105. In another embodiment, the horizontal angle 132 is approximately eighteen degrees. The vertical angle 134 is approximately 2 to 10 degrees relative to the vertical surface 108. In another embodiment, the vertical angle is approximately 6 degrees. This positioning allows the surfaces 130 of each reflector 102, when disposed within each luminaire casing 104 proximate the lamp 105 (as is shown in FIGS. 3-5), to receive light output 124 directly from a forward facing side 136 of the central region 122 of each respective lamp 105, and redirect the output light 124 to the area 111 of diminished low illuminance, thus reducing socket shadow on the surface 108.

Similarly to the first embodiment, it should be appreciated that the reflectors 102 may be disposed with each respective luminaire casing 104 via a threaded mounting. As shown in FIGS. 3-5, the reflectors 102 are threadingly mounted to the luminaire casings 104 via threaded instruments 140 disposed through mounting openings 142 defined by a horizontal edge 141 extending from the reflectors 102. This threaded association fixedly mounts the reflectors 102 with the casings 104, allowing the angles and positioning discussed above to remain constant. This fixation arrangement, employed be example herein with respect to both reflectors 12 and 102 is merely illustrative. In another embodiment, the reflectors 12 and 102 may be fixed within the respective luminaire casings 16 and 104 by welding, adhesives, friction fit, etc., or formed integrally with the casings.

Here, as discussed with the luminaire 10, the reflectors 102 are disposed and oriented so as to receive output light 124 from the central region of the lamps 105 and to reflect this light to the area of low luminance 111. The advantageous disposition of the reflectors 102 thus reduces the effect of socket shadow while not significantly interfering with output light 124 incident upon the specular surfaces adjacent to the reflectors 102, said output light 124 being directed to the target surface.

The approximate angles given above with respect to the various surfaces of the reflectors 12 and 102 are of course merely exemplary and may be varied within the broad scope of the invention. For example, these angles may vary based upon the size, disposition, and configuration of the vertical surface, the distance of the vertical surface from the reflectors 12 and 102, the light intensity emitted from the lamps, etc.

The reflectors described herein may be formed of any specular or semi-specular material (e.g., a metal, plastic, etc.) or may be composed of any desired material with a specular or semi-specular finish, layer, or coating applied thereto.

While the luminaires described herein are generally up-light type luminaires configured to provide light upwardly toward a wall and a ceiling, the reflector of the invention may similarly be employed in a down-light luminaire arrangement. For example, a luminaire may be mounted on a vertical wall or a partition, such as in an office, where the luminaire includes at least two linearly tandem lamps configured to emit output light downwardly toward the vertical surface and/or a lower horizontal surface such as a floor or a task area such as an office desk. For reasons discussed above concerning luminaires 10 and 100, the present tandem lamp arrangement may produce an undesired socket shadow at the vertical surface beneath the luminaire. Accordingly, this down-light luminaire may include a reflector similar to the reflectors 12 and 102 discussed above. Such reflector receives light output from the tandem lamps and directs it to the socket shadow area on the vertical surface beneath the luminaire thus reducing this area of reduced luminance.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. An apparatus for reducing socket shadow in an area of low luminance on a surface proximate to the apparatus, the apparatus comprising:

a luminaire casing including a first end and a second end opposite said first end, said luminaire casing disposed proximate to the surface, wherein the surface is arranged external to the casing;

at least two linearly adjacent tandem lamps disposed in said luminaire casing, said at least two lamps each capable of emitting a light output to the surface, said at least two lamps being disposed in a first region;

a region of diminished radiant exitance disposed between adjacent ends of said at least two linearly adjacent lamps, said region of diminished radiant exitance emitting a lower light output than said light output emitted from said at least two lamps, said region of diminished radiant exitance forming the area of low luminance on the surface; and a reflector disposed on said luminaire casing, said reflector being disposed with respect to said at least two lamps to redirect said light output emitted from said at least two lamps to the area of low luminance on the surface, wherein said reflector is disposed in a second region, said second region being disposed proximate to said second end relative to said first region, and said first region being disposed proximate to said first end relative to said second region, a space being delimited between said first region and said second region.

2. The apparatus of claim 1, wherein said region of diminished radiant exitance at least comprises a cathode region, an opaque cap, a lampholder, and a lampholder bracket of each of said at least two lamps.

3. The apparatus of claim 1, wherein said reflector includes two flat surfaces that are generally erect and angled with respect to said at least two lamps.

4. The apparatus of claim 3, wherein said flat surfaces are positioned at a horizontal angle to said at least two lamps and reclined from said at least two lamps at a vertical angle.

5. The apparatus of claim 4, wherein said horizontal angle is about 18 degrees, and said vertical angle is about 6 degrees.

6. The apparatus of claim 2, wherein said two flat surfaces have a specular finish.

7. The apparatus of claim 1, wherein the luminaire casing is disposed on a vertical surface, wherein the area of low luminance is formed on the vertical surface, and wherein the reflector is configured to direct the light output from the lamps to a surface generally orthogonal to the vertical surface.

8. An apparatus for reducing socket shadow in an area of low luminance on a surface proximate the apparatus, the apparatus comprising:

a luminaire casing including at least one contact side, a first end, and a second opposite said first end, said luminaire casing being disposed proximate to the surface, wherein the surface is arranged external to the casing;

at least one lamp disposed in said luminaire casing, said at least one lamp including two ends, at least one of said two ends contacting said at least one contact side, said lamp capable of emitting a light output the surface, said at least one lamp being disposed in a first region;

a region of diminished radiant exitance disposed between at least one of said two ends of said at least one lamp and said at least one contact side, said region of diminished radiant exitance emitting a lower light output than said light output emitted from said at least one lamp to form said area of low luminance on the surface; and a reflector disposed with said luminaire casing, said reflector being disposed with respect to said at least one lamp to redirect said light output emitted from said at least one lamp to the area of low luminance on the surface, wherein said reflector is disposed in a second region, said second region being disposed proximate to said second end relative to said first region, and said first region being disposed proximate to said first end relative to said second region, a space being delimited between said first region and said second region.

9. The apparatus of claim 8, wherein said region of diminished radiant exitance comprises a cathode region, an opaque cap, a lampholder, and lampholder bracket of said at least one lamp.

10. The apparatus of claim 8, wherein said reflector includes a flat surface that is erect and angled with respect to said at least one lamp.

11. The apparatus of claim 10, wherein said flat surface is positioned at a horizontal angle to said at least one lamp and reclined from said at least one lamp at a vertical angle.

12. The apparatus of claim 11, wherein said horizontal angle is about 18 degrees, and said vertical angle is about 6 degrees.

13. The apparatus of claim 10, wherein said flat surface has a specular finish.

14. The apparatus of claim 8, wherein the luminaire casing is disposed on a vertical surface, wherein the area of low luminance is formed on the vertical surface, and wherein the reflector is configured to direct the light output from the lamp to a surface generally orthogonal to the vertical surface.

15. An apparatus for reducing socket shadow in an area of low luminance, the apparatus comprising:

at least two linearly adjacent tandem luminaire casings each including at least one lamp capable of emitting a light output;

a region of diminished radiant exitance disposed substantially between adjacent ends of said at least two linearly adjacent luminaire casings, said region of diminished radiant exitance emitting a lower light output than said light output emitted from said at least one lamp, said area of diminished radiant exitance forming the area of low luminance; and a reflector separately disposed on each of said at least two luminaire casings, said reflector being disposed with respect to said at least one lamp in each of said at least two casings to redirect said light output emitted from said at least one lamp to the area of low luminance.

16. The apparatus of claim 15, wherein said region of diminished radiant exitance comprises a cathode region, an opaque cap, a lampholder, and a lampholder bracket of said at least one lamp, as well as said space between said at least two linearly adjacent luminaire casings.

17. The apparatus of claim 15, wherein said reflector includes a flat surface that is erect and angled with respect to said at least one lamp in each of said at least two casings, wherein said flat surface is positioned at a horizontal angle to said at least one lamp in each of said at least two casings and reclined from said at least one lamp at a vertical angle, and wherein said horizontal angle is about 18 degrees, and said vertical angle is about 6 degrees.

18. A reflector for reducing socket shadow in an area of low luminance created by linearly tandem lamps of a luminaire, the reflector comprising:

a first reflective generally planar surface;

a second reflective generally planar surface; and fixation means for securing the reflector within the luminaire;

wherein the first and second reflective surfaces are connected at first ends thereof; and wherein the first and second reflective surfaces are disposed within the luminaire at an angle of about 10 to 30 degrees with respect to a longitudinal axis of the tandem lamps and at an angle of about 2 to 10 degrees with respect to a vertical.

19. The reflector of claim 18, wherein the angle with respect to the longitudinal axis is about 18 degrees and the angle with respect to the vertical axis about 6 degrees.

20. The reflector of claim 18, wherein first and second surfaces are configured and positioned to reflect light emitted from the tandem lamps to the area of low luminance.

21. The apparatus of claim 1, wherein the luminaire casing is disposed on a vertical surface, wherein the area of low luminance is formed on the vertical surface and a surface disposed at an angle to the vertical surface, wherein the reflector is configured to direct the light output from the lamps to the vertical surface and the surface disposed at an angle to the vertical surface.

22. The apparatus of claim 21, wherein the surface disposed at an angle to the vertical surface is a ceiling.

23. The apparatus of claim 8, wherein the luminaire casing is disposed on a vertical surface, wherein the area of low luminance is formed on the vertical surface and a surface disposed at an angle to the vertical surface, wherein the reflector is configured to direct the light output from the lamp to the vertical surface and the surface disposed at an angle to the vertical surface.

24. The apparatus of claim 23, wherein the surface disposed at an angle to the vertical surface is a ceiling.

* * * * *